US010130128B2

(12) United States Patent
Andrews et al.

(10) Patent No.: US 10,130,128 B2
(45) Date of Patent: Nov. 20, 2018

(54) CUT RESISTANT GLOVES AND METHODS OF MAKING SAME

(71) Applicant: World Fibers, Inc., Concord, NC (US)

(72) Inventors: Gregory V. Andrews, Concord, NC (US); Rayvon A. Morton, Oakboro, NC (US); Paul W. Cornelison, Salisbury, NC (US); John D. Simmons, Rockwell, NC (US)

(73) Assignee: World Fibers, Inc., Concord, NC (US)

( * ) Notice: Subject to any disclaimer, the term of this patent is extended or adjusted under 35 U.S.C. 154(b) by 945 days.

(21) Appl. No.: 14/210,533

(22) Filed: Mar. 14, 2014

(65) Prior Publication Data

US 2014/0259285 A1 Sep. 18, 2014

Related U.S. Application Data

(60) Provisional application No. 61/789,990, filed on Mar. 15, 2013.

(51) Int. Cl.
*A41D 19/015* (2006.01)

(52) U.S. Cl.
CPC ..... *A41D 19/01505* (2013.01)

(58) Field of Classification Search
CPC ..... A41D 19/015; A41D 19/015; A41D 19/01511; A41D 19/01517; A41D 19/01558; A41D 19/01547; A41D 19/0096
USPC ..... 2/167, 16, 21, 163
See application file for complete search history.

(56) References Cited

U.S. PATENT DOCUMENTS 889,397 A * 6/1908 O'Shaughnessy ..... A41D 19/00 2/159
4,146,935 A * 4/1979 Hinton ..... A41D 19/01547 2/161.3
4,384,449 A * 5/1983 Byrnes, Sr. ..... A41D 19/01511 139/425 R
4,470,251 A * 9/1984 Bettcher ..... A41D 19/01511 2/16
4,519,781 A * 5/1985 Boyd ..... A41D 19/00 2/160

(Continued)

FOREIGN PATENT DOCUMENTS

EP 118898 A2 9/1984
EP 2468121 A1 6/2012

(Continued)

OTHER PUBLICATIONS

International Search Report for International Application No. PCT/US2015/032839, dated Oct. 15, 2015.

(Continued)

*Primary Examiner* — Alissa L Hoey
(74) *Attorney, Agent, or Firm* — Ashley Law Firm P.C.; Stephen S. Ashley, Jr.

(57) ABSTRACT

A cut resistant glove includes a primary layer and a plurality of enhanced sections having substantially enhanced physical characteristics in relation to the primary layer. The glove includes a palm section, a back hand section, a thumb section and a plurality of finger sections. The enhanced sections can be knitted to the primary layer by a whole garment, computer controlled slide needle knitting machine at positions on the glove where enhanced physical characteristics are desired.

14 Claims, 6 Drawing Sheets

(56) References Cited

U.S. PATENT DOCUMENTS 4,651,514 A * 3/1987 Collett ..... A41D 31/0055 2/167
4,777,789 A * 10/1988 Kolmes ..... D02G 3/12 2/167
4,825,470 A * 5/1989 Horio ..... A41D 13/087 2/161.8
4,838,017 A * 6/1989 Kolmes ..... D02G 3/12 2/167
4,912,781 A * 4/1990 Robins ..... A41D 19/01511 2/16
5,113,532 A * 5/1992 Sutton ..... A41D 19/0058 2/16
5,119,512 A * 6/1992 Dunbar ..... A41D 19/01511 139/420 R
5,224,363 A * 7/1993 Sutton ..... A41D 19/0058 2/16
5,231,700 A * 8/1993 Cutshall ..... A41D 19/01505 2/161.7
5,248,548 A * 9/1993 Toon ..... A41D 19/01511 2/167
5,345,609 A * 9/1994 Fabry ..... A41D 19/01523 2/161.1
5,442,815 A * 8/1995 Cordova ..... A41D 19/0055 2/161.7
5,568,657 A 10/1996 Cordova
5,597,649 A 1/1997 Sandor
5,628,172 A * 5/1997 Kolmes ..... D02G 3/442 2/167
5,640,712 A * 6/1997 Hansen ..... A41D 19/01523 2/16
5,965,223 A 10/1999 Andrews et al.
6,021,523 A * 2/2000 Vero ..... A41D 19/01511 2/159
6,033,779 A 3/2000 Andrews
6,052,829 A * 4/2000 Kindler ..... A41D 19/01576 2/16
6,155,084 A * 12/2000 Andrews ..... A41D 13/08 2/16
6,161,400 A * 12/2000 Hummel ..... A41D 19/01505 2/16
6,216,431 B1 4/2001 Andrews
6,279,305 B1 * 8/2001 Hummel ..... A41D 19/01511 57/210
6,457,182 B1 * 10/2002 Szczesuil ..... A41D 19/01511 2/16
6,581,212 B1 6/2003 Andresen
6,581,366 B1 6/2003 Andrews
6,625,815 B2 * 9/2003 Litke ..... A63B 71/143 2/161.2
6,766,635 B2 7/2004 Andrews
6,779,330 B1 8/2004 Andrews et al.
6,782,720 B2 8/2004 Vero et al.
6,803,332 B2 10/2004 Andrews
6,962,064 B1 * 11/2005 Hardee ..... A41D 19/00 2/159
7,007,308 B1 * 3/2006 Howland ..... A41D 19/01505 2/16
7,121,077 B2 10/2006 Andrews et al.
7,365,031 B2 * 4/2008 Swallow ..... D02G 3/38 174/124 R
7,434,422 B2 10/2008 Thompson et al.
7,555,921 B2 7/2009 Thompson et al.
7,636,951 B2 * 12/2009 Morrow ..... A63B 71/143 2/16
7,802,316 B2 * 9/2010 Hofmann ..... A41D 19/01576 2/159
7,886,369 B2 * 2/2011 Nagao ..... A41D 19/015 2/161.1
8,074,436 B2 12/2011 Hardee et al.
8,239,969 B2 8/2012 Fisher
8,490,217 B2 * 7/2013 Safford ..... A41D 19/015 2/161.6
8,726,418 B2 * 5/2014 DeBlasis ..... A41F 1/06 2/161.1
9,241,520 B2 * 1/2016 Curl ..... A41D 19/01582
9,538,797 B2 * 1/2017 Jones ..... A41D 19/0013
9,591,881 B1 * 3/2017 Sarkissian ..... A41D 19/0051
9,622,525 B2 * 4/2017 Safford ..... A41D 19/01529
2002/0042940 A1 * 4/2002 Kuroda ..... A41D 19/01582 2/161.1
2003/0140396 A1 * 7/2003 Vero ..... A41D 19/01505 2/167
2006/0130210 A1 * 6/2006 Gait ..... A41D 19/01523 2/160
2006/0212990 A1 * 9/2006 Mattesky ..... A41D 19/0006 2/161.6
2008/0289312 A1 * 11/2008 Takada ..... A41D 19/01511 57/232
2009/0070916 A1 * 3/2009 Kassam ..... A41D 19/01505 2/158
2009/0126058 A1 * 5/2009 Loos ..... F41H 1/00 2/2.5
2009/0126074 A1 * 5/2009 Mattesky ..... A41D 19/0065 2/161.8
2009/0139011 A1 * 6/2009 VanErmen ..... A41D 19/01505 2/161.8
2009/0183296 A1 * 7/2009 Hardee ..... D02G 3/185 2/161.8
2009/0210991 A1 * 8/2009 Tutor ..... A41D 19/015 2/161.8
2009/0229035 A1 * 9/2009 Van Hale ..... A41D 19/002 2/161.6
2010/0095428 A1 4/2010 Fisher
2010/0186142 A1 * 7/2010 Kume ..... A41D 19/01564 2/161.1
2010/0186144 A1 * 7/2010 Zhu ..... A41D 19/01511 2/167
2010/0186455 A1 * 7/2010 Zhu ..... A41D 19/01505 66/174
2010/0186457 A1 * 7/2010 Zhu ..... A41D 19/01505 66/174
2010/0192279 A1 * 8/2010 Hunsicker ..... A41D 19/002 2/161.2
2010/0192281 A1 * 8/2010 Koesterich ..... A41D 19/01505 2/167
2010/0275341 A1 11/2010 Sweeney et al.
2010/0275342 A1 11/2010 Sweeney et al.
2011/0047672 A1 * 3/2011 Hatfield ..... A41D 19/0024 2/163
2011/0088139 A1 * 4/2011 Travell ..... A41D 19/01588 2/161.1
2011/0162128 A1 * 7/2011 Welton ..... A41D 31/0061 2/163
2011/0231985 A1 * 9/2011 Bishop ..... A41D 13/05 2/456
2011/0265245 A1 * 11/2011 Asiaghi ..... G06F 3/014 2/167
2011/0289643 A1 * 12/2011 Mazzarolo ..... A41D 19/01505 2/16
2012/0131715 A1 * 5/2012 Copeland ..... A63B 71/143 2/16
2012/0204604 A1 8/2012 Azeem et al.
2012/0233740 A1 * 9/2012 Veillet ..... A41D 19/01505 2/163
2013/0076699 A1 * 3/2013 Spencer ..... G06F 3/044 345/179
2013/0180027 A1 * 7/2013 Rock ..... A41D 19/01505 2/167
2013/0213094 A1 8/2013 Moreland et al.
2013/0263354 A1 * 10/2013 Gibby ..... A63B 71/14 2/161.1
2014/0109290 A1 * 4/2014 Ghazaly ..... A41D 19/01505 2/167
2014/0165262 A1 * 6/2014 Klausner ..... G06F 3/014 2/161.1
2014/0283559 A1 * 9/2014 Andrews ..... A41D 19/01505 66/174

(56) References Cited

U.S. PATENT DOCUMENTS

| | | | | |
|---|---|---|---|---|
| 2015/0181956 | A1* | 7/2015 | Andrews | A41D 19/01511 2/167 |
| 2015/0220146 | A1* | 8/2015 | Fisher | G06F 3/014 2/167 |
| 2016/0073713 | A1* | 3/2016 | Takata | A41D 19/01505 2/167 |

FOREIGN PATENT DOCUMENTS

| | | | |
|---|---|---|---|
| RU | 55256 | U1 | 10/2006 |
| SU | 1369661 | A3 | 1/1988 |
| WO | WO2000015063 | A1 | 3/2000 |
| WO | WO00/65941 | A1 | 11/2000 |
| WO | WO2007024872 | A2 | 3/2001 |

OTHER PUBLICATIONS

Written Opinion of the International Searching Authority for International Application No. PCT/US2015/032839, dated Oct. 15, 2015.
espace.net, English translation of RU55256, Feb. 11, 2016.
espace.net, English translation of abstract of SU1369661, Feb. 11, 2016.

* cited by examiner

CUT RESISTANT GLOVES AND METHODS OF MAKING SAME

CROSS REFERENCE TO RELATED APPLICATIONS

This application claims priority to U.S. Provisional Patent Application No. 61/789,990, filed Mar. 15, 2013, which is incorporated herein.

TECHNICAL FIELD AND BACKGROUND OF THE INVENTION

The present invention relates to cut resistant gloves, and methods for making cut resistant gloves. One embodiment of the invention comprises a cut resistant glove knit on a whole garment, computer controlled slide needle knitting machine.

Cut resistant gloves are typically knitted on conventional glove knitting machines, which produce only a jersey knit pattern. However, it would be desirable to produce cut resistant gloves in other knit patterns.

SUMMARY OF THE INVENTION

Therefore, one object of the present invention is to provide a method for making cut resistant gloves in a variety of knit patterns, such as full jacquard, intarsia, mesh or combinations of these patterns. These and other objects of the invention can be obtained in the preferred embodiments of the invention described below.

One embodiment of the invention comprises a method for making cut resistant gloves in a variety of knit patterns in order to enhance properties of different parts, regions or sections of the gloves. Another embodiment of the invention comprises a cut resistant glove for use in food preparation having enhanced cut resistance protection sections on high risk/wear areas of the glove. Yet another embodiment of the invention comprises a cut resistant glove with touch screen operation compatibility.

A glove according to another embodiment of the invention comprises a palm section, a back hand section, a thumb section and a plurality of finger sections. A primary layer defines the palm section and the back hand section and at least a substantial portion of the thumb section and the plurality of finger sections. The glove includes a plurality of enhanced sections having substantially enhanced physical characteristics in relation to the primary layer.

According to another embodiment of the invention, the enhanced sections are positioned on the glove to cover a back side of a wearer's thumb and back sides of a wearer's index finger, middle finger and ring finger.

According to another embodiment of the invention, the enhanced sections are positioned on the glove to cover middle phalanges of the wearer's index finger, middle finger and ring finger fingers and a distal phalanx of the wearer's thumb.

According to another embodiment of the invention, the enhanced sections are positioned on the glove to cover the distal phalanges of the wearer's thumb, index finger and middle finger.

According to another embodiment of the invention, the enhanced sections have increased abrasion resistance in relation to the primary layer.

According to another embodiment of the invention, the enhanced sections are comprised of ultra high molecular weight polyethylene, high tenacity nylon, high tenacity polyester, and/or liquid crystal polymer.

According to another embodiment of the invention, the primary layer comprises a first yarn formed in the palm section, the back hand section, the thumb section and the plurality of finger sections, and the enhanced sections are comprised of a second yarn knitted to the first yarn at portions of the thumb section and the finger sections.

According to another embodiment of the invention, the second yarn is knitted to the first yarn by a whole garment, computer controlled slide needle knitting machine.

According to another embodiment of the invention, the second yarn has substantially greater cut resistance than the first yarn. As such, the enhanced sections have enhanced cut resistance.

According to another embodiment of the invention, the first yarn comprises a core strand comprised of fiberglass, a first cover strand comprised of ultra high molecular weight polyethylene wrapped around the core, and a second cover strand comprised of polyester wrapped over the first cover strand.

According to another embodiment of the invention, the first yarn includes a third cover strand comprised of polyester is wrapped over the second cover strand.

According to another embodiment of the invention, the second yarn comprises a core strand comprised of spandex, and a cover strand comprised of ultra high molecular weight polyethylene wrapped around the core strand.

A cut resistant glove according to another embodiment of the invention comprises a primary layer of material defining a palm section, a back hand section, a thumb section, an index finger section, a middle finger section, a ring finger section and a baby finger section, and a secondary layer of material having increased cut resistance in relation to the primary layer. The secondary layer can be knitted to the primary layer at portions of the thumb section, index finger section and middle finger section.

According to another embodiment of the invention, the secondary layer of material is comprised of ultra high molecular weight polyethylene, high tenacity nylon, high tenacity polyester, and/or liquid crystal polymer.

According to another embodiment of the invention, the secondary layer comprises a yarn comprising a core strand comprised of spandex, and a cover strand comprised of ultra high molecular weight polyethylene wrapped around the core strand.

According to another embodiment of the invention, the primary layer is comprised of a yarn comprising a core strand comprised of fiberglass, a first cover strand comprised of ultra high molecular weight polyethylene wrapped around the core, and a second cover strand comprised of polyester wrapped over the first cover strand.

According to another embodiment of the invention, the secondary layer is knitted to the primary layer at positions to cover a back side of middle phalanges of a wearer's index finger, middle finger and ring finger and a back side of a distal phalanx of the wearer's thumb.

A cut resistant glove according to another embodiment of the invention comprises a primary layer comprising a cut resistant material and defines a palm section, a back hand section, a thumb section, an index finger section, a middle finger section, a ring finger section and a baby finger section. A secondary layer comprising an electrically conductive material is knitted to the primary layer on tips of the thumb section, index finger section and middle finger section.

According to another embodiment of the invention, the primary layer of material comprises a yarn comprised of ultra high molecular weight polyethylene, high tenacity nylon, high tenacity polyester, and/or liquid crystal polymer. The secondary layer of material comprises a yarn comprised of silver-coated nylon and/or copper-coated nylon.

DESCRIPTION OF PREFERRED EMBODIMENTS OF THE INVENTION AND BEST MODE

Figure 1:
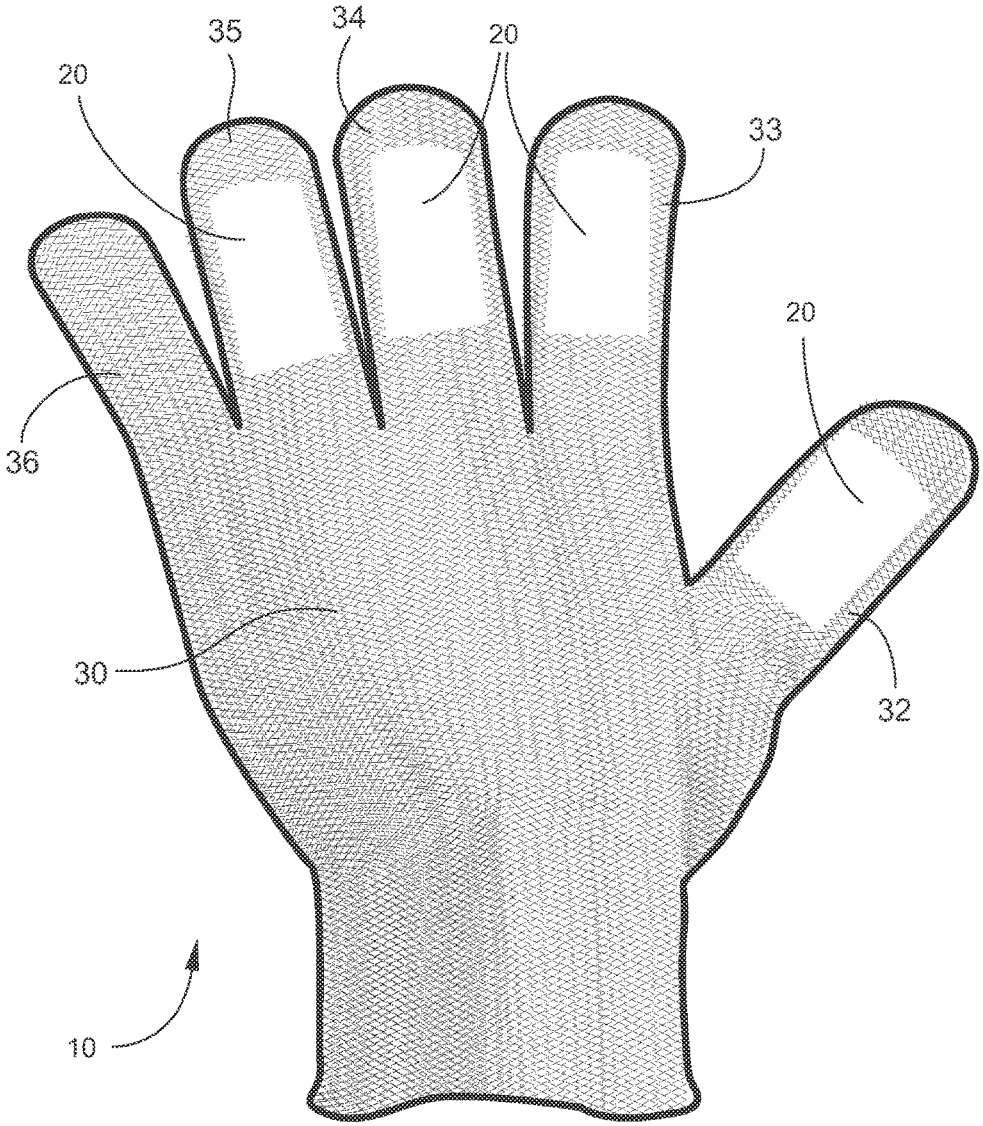
FIG. 1 is a back side view of a cut resistant glove according to a preferred embodiment of the invention.
Figure 2:
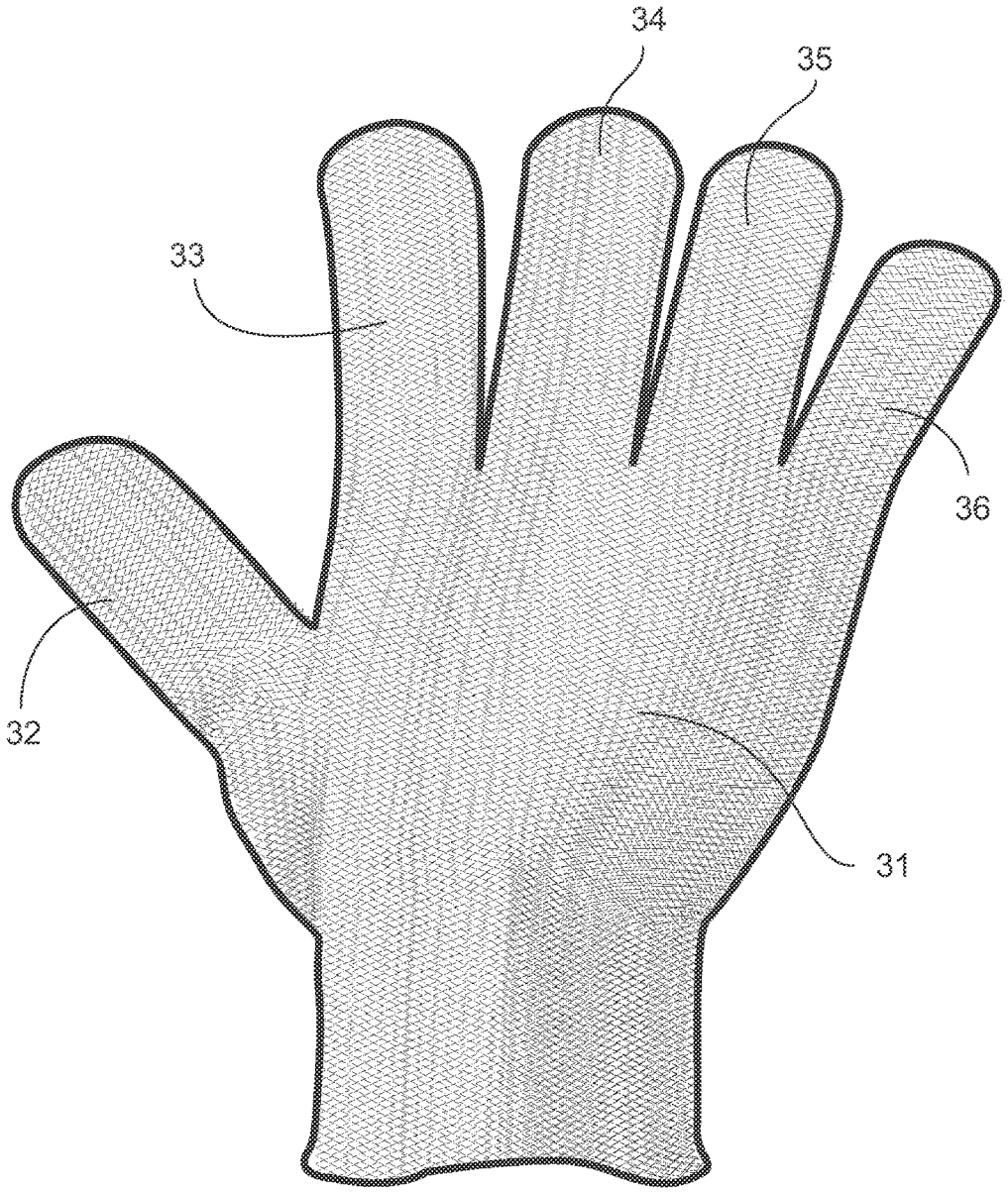
FIG. 2 is a front side view of the cut resistant glove of FIG. 1.

A cut resistant glove according to a preferred embodiment of the invention is illustrated in FIGS. 1 and 2, and shown generally at reference numeral 10. The glove 10 is knitted on a whole garment, computer controlled slide needle knitting machine, such as the SWG Whole Garment Knitting Machine produced by Shima Seiki, shown in FIG. 5 at reference numeral 100.

FIG. 1 shows the back side of the glove 10, and FIG. 2 shows the front side of the glove. As shown in FIGS. 1 and 2, the glove 10 has a back hand section 30, a palm section 31, a thumb section 32, an index finger section 33, a middle finger section 34, a ring finger section 35 and a baby finger section 36. As shown in FIG. 2, the thumb section 32 and each of the finger sections 33-36 has a front side that is co-planar with the palm section 31. As shown in FIG. 1, the thumb section 32 and each of the finger sections 33-36 has a back side that is co-planar with the back hand section 30 of the glove.

The glove 10 can be made with materials sufficiently cut resistant to achieve a minimum of Level 2 cut resistance according to the ANSI 105-2005 *American National Standard for Hand Protection Selection Criteria*. In accordance with *ASTM F*1790-05 *Test Method for Measuring Cut Resistance of Materials Used in Protective Clothing*, a glove is classified at Level 2 Cut Resistance when the weight on a blade needed to cut through the material with twenty millimeters of blade travel is equal to or exceeds five hundred grams.

Figure 3:
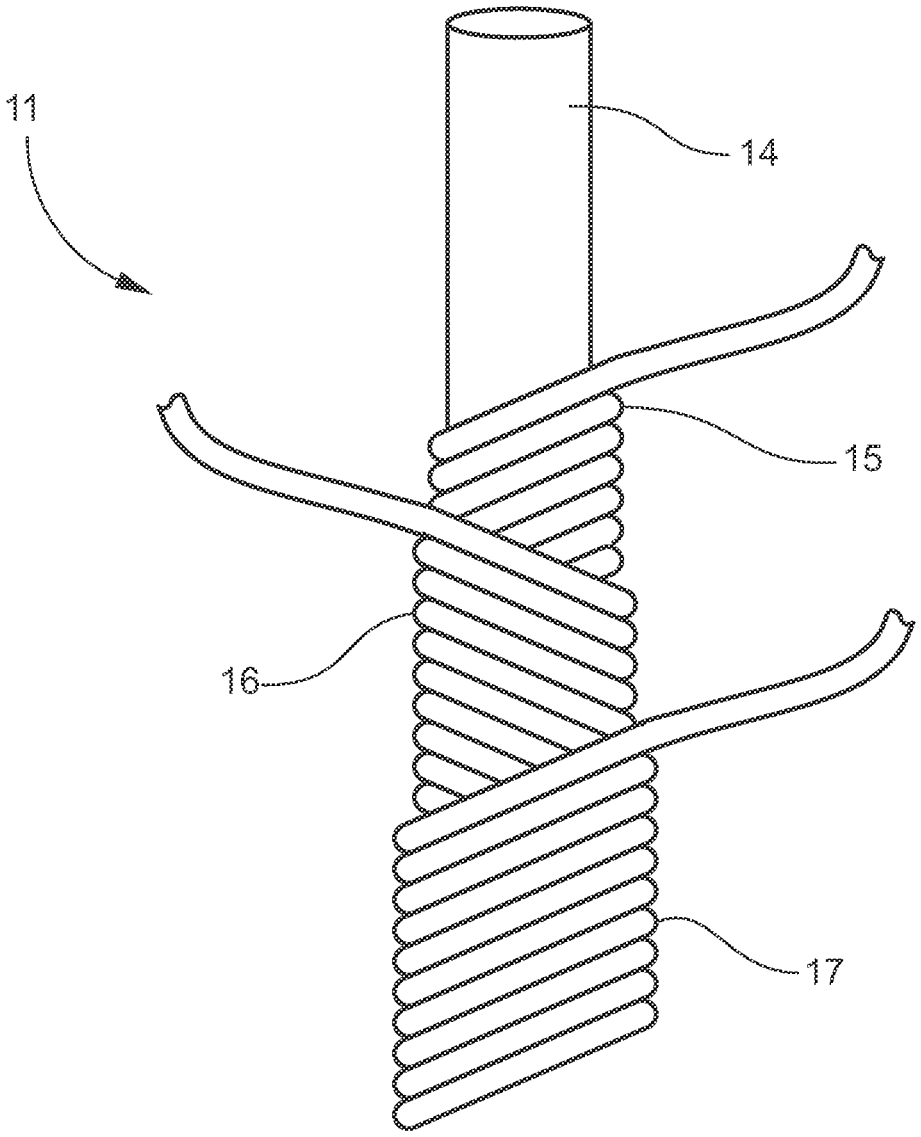
FIG. 3 is a schematic view of a cut resistant yarn according to a preferred embodiment of the invention.

The glove 10 can be made with a cut resistant yarn 11 (referred hereinafter as "primary cut resistant yarn"). The primary cut resistant yarn 11 can be comprised of a core strand 14 of D450 (one hundred denier) fiberglass, a first cover strand 15 of four hundred denier ultra high molecular weight polyethylene (sold under the name Dyneema) wrapped around the core, a second cover strand 16 of one hundred fifty denier textured polyester wrapped over the first cover 15, and a third cover 17 strand of one hundred fifty denier textured polyester wrapped over the second cover 16, as shown in FIG. 3.

The glove 10 can be knitted on the whole garment slide needle knitting machine 100 in a variety of knit patterns, such as full jacquard, intarsia, mesh or combinations of these patterns, to enhance properties of different parts, regions or sections of the glove. Portions of the glove 10 can be enhanced with added cut protection in areas of the glove exposed to the greatest hazard, with other patterns being made lighter or more flexible to enhance the comfort of the glove to the wearer.

Figure 5:
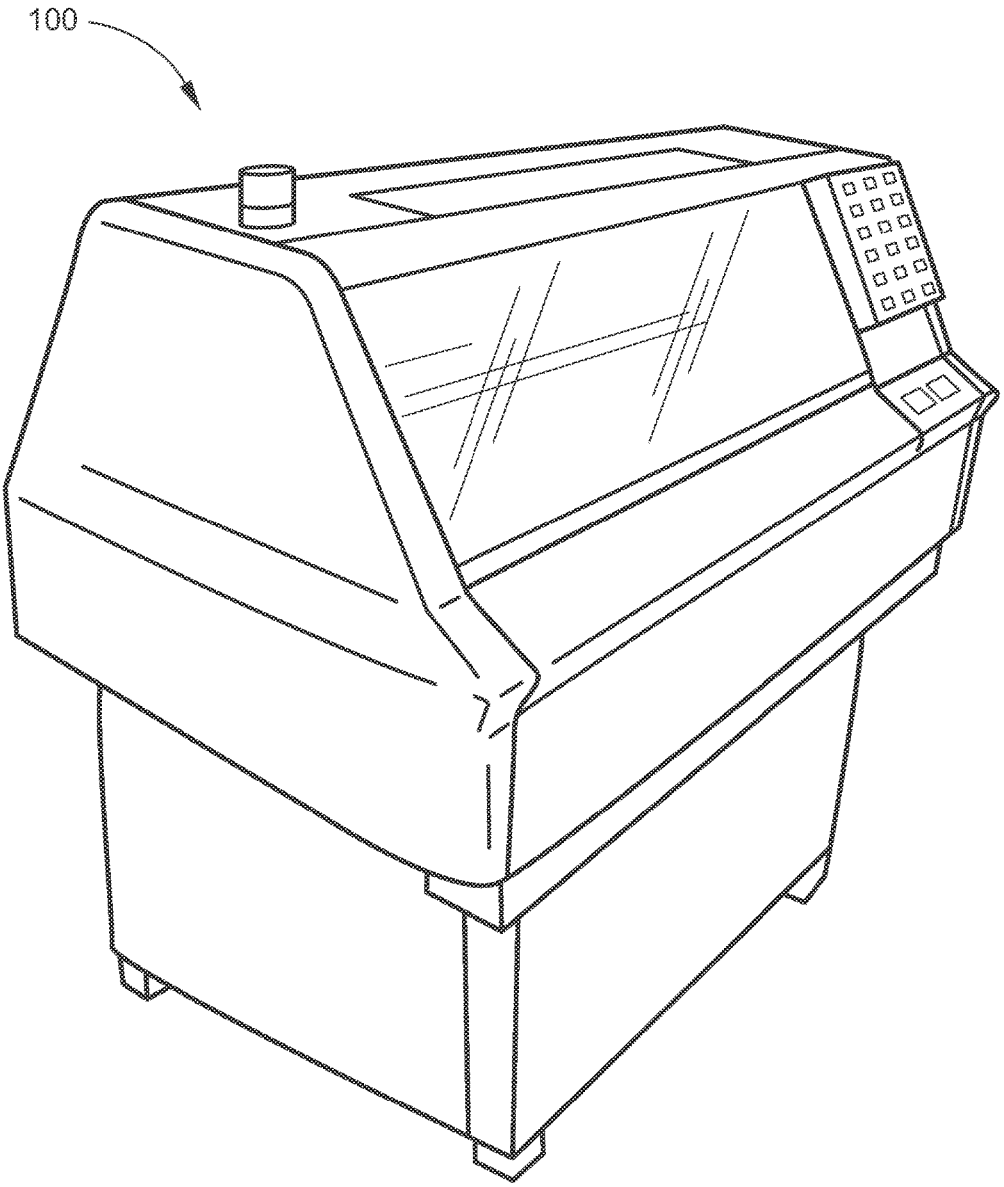
FIG. 5 is a perspective view of equipment used in methods of making cut resistant gloves according to a preferred embodiment of the invention.

The cut resistant glove 10 can be produced on a whole garment slide needle knitting machine 100, shown in FIG. 5, wherein sections of the glove 10 are enhanced with different or additional materials to increase the cut and/or abrasion resistance of the areas subject to greatest hazard or wear. Materials that can be used as yarns to enhance cut resistance and/or abrasion resistance in special areas of the glove include ultra high molecular weight polyethylene (Dyneema and/or Spectra), high tenacity nylon, high tenacity polyester, liquid crystal polymer (Vectran), and other engineered composite yarns.

In one embodiment of the invention, the glove 10 can be adapted particularly for use in food preparation and/or processing. In the preparation of food such as vegetables by kitchen and food processing workers, the areas between the first and second knuckles (middle phalanges) on the fingers of the hand guiding the food are typically used as guides for the knife blade. As such, these particular areas of the finger are at a higher hazard risk of being cut by the blade. This often leads to increased wear on the areas of the glove covering these high risk areas.

Figure 4:
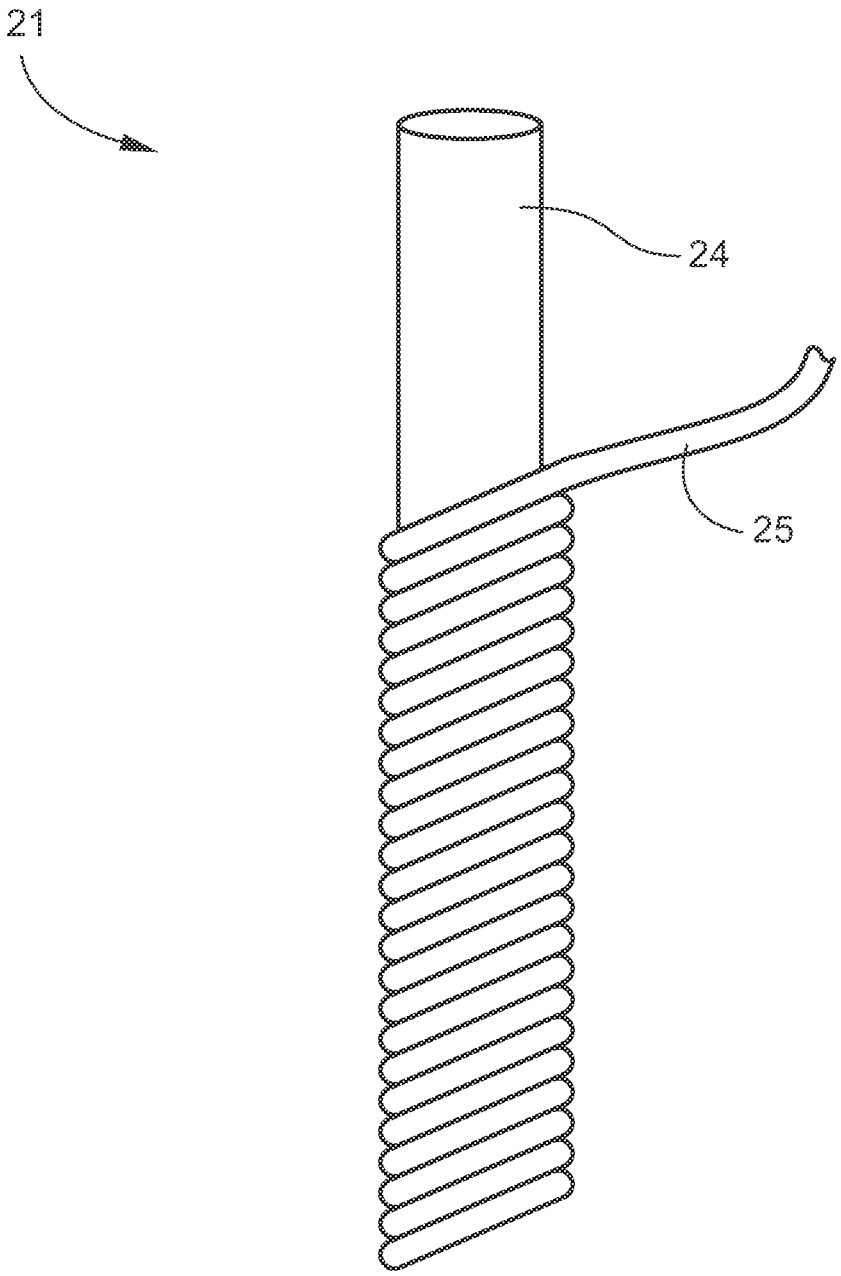
FIG. 4 is a schematic view of another cut resistant yarn according to a preferred embodiment of the invention.

The glove 10 can be constructed with enhanced cut resistance sections 20 located approximately on the back of the fingers between the first and second knuckles (middle phalanges) of the index finger 33, middle finger 34 and ring finger 35 and the back of the upper portion (distal phalanx) of the thumb 60, as shown in FIG. 1. The glove 10 can be generally constructed with the primary cut resistant yarn 11 described above, and the enhanced cut resistant sections 20 can be comprised of the primary cut resistant yarn 11 and an additional layer of material comprising a secondary cut resistant yarn 21. As shown in FIG. 4, the secondary cut resistant yarn can be comprised of a core 24 of an elastic fiber such as seventy denier spandex, and a cover 25 wrapped around the core 24 comprised of four hundred denier ultra high molecular weight polyethylene (Dyneema). The Dyneema on the surface of the enhanced sections 20 provides added cut resistance and abrasion (wear) resistance to the areas of the fingers used as a blade guide when chopping foods.

In this embodiment the enhanced sections 20 comprise a layer of a secondary cut resistant yarn 21 in addition to the primary cut resistant yarn 11. In an alternative embodiment, the enhanced sections 20 can be comprised of a substitute layer of material having superior cut resistance that entirely replaces the primary cut resistant material being used in all other areas of the glove 10. The whole garment slide needle knitting machine 100, shown in FIG. 5, permits the replacement of the primary cut resistant yarn 11 with larger and/or more cut resistant yarns in the enhanced cut resistant sections 20.

Figure 6:
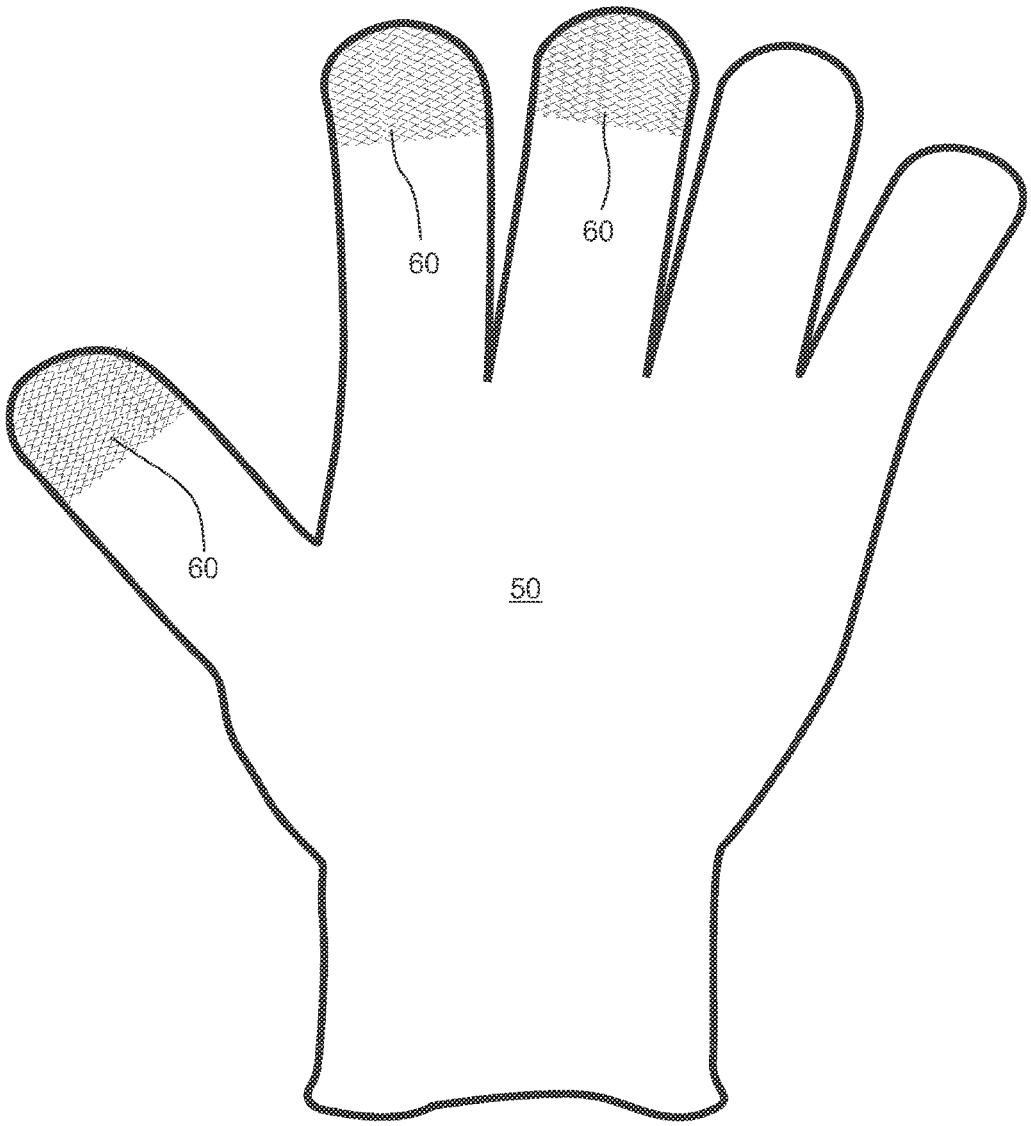
FIG. 6 is a front side view of a cut resistant glove according to another preferred embodiment of the invention.

A cut resistant glove according to another preferred embodiment of the invention is illustrated in FIG. 6, and shown generally at reference numeral 50. The cut resistant glove 50 can be adapted for use with an electronic touch screen device. FIG. 5 shows the front side of the glove 50.

Personnel wearing cut resistant gloves in the workplace are often required to manipulate touch-screen devices for inventory, order processing, communication and the like. With typical cut resistant gloves, the wearer must remove the glove before using the touch screen device.

The cut resistant glove 50 includes enhanced finger pad sections 60 located at the tips (distal phalanges) of the thumb, index finger and middle finger, as shown in FIG. 6. The finger pad areas 60 comprise electrically conductive materials enabling the wearer to operate a touch screen on an electronic device while wearing the glove 50 by contacting the touch screen with the enhanced finger pad sections 60. As such, the wearer may keep the glove 50 on his hand and use the touch screen device without having to remove the glove 50.

The enhanced finger pad sections 60 can be made using the whole garment slide needle knitting machine 100. The glove 50 can be generally comprised of the primary cut resistant yarn 11 described above, and an additional layer comprised of an electrically conductive yarn is knitted in the fingertip areas on the palm side to form the enhanced finger pad sections 60. Preferably, the conductive yarn is comprised of a non-abrasive fiber, such as silver-coated nylon (X-Static) fiber. Other conductive yarns can be used, such as copper-coated nylon (Thunderon) or other metal-containing yarns.

The enhanced sections 60 on the cut resistant glove 50 can be produced by adding a layer of conductive material in only the specific areas desired using the whole garment knitting machine 100. The whole garment machine knitting machine 100 has programmed control over each needle, which controls each needle and the stitch quality or characteristic of each stitch, and allows for creating layers, changing yarns, or changing patterns or knit type.

Cut resistant gloves and methods of making same are described above. Various changes can be made to the invention without departing from its scope. The above description of embodiments and best mode of the invention are provided for the purpose of illustration only and not limitation—the invention being defined by the claims and equivalents thereof.

What is claimed is:

1. A glove comprising:

(a) a palm section, a back hand section, a thumb section, an index finger section, a middle finger section, a ring finger section and a baby finger section, wherein each of the thumb section, the index finger section, the middle finger section, the ring finger section and the baby finger section include a front side that is co-planar with the palm section and a back side that is co-planar with the back hand section;

(b) a primary layer defining the palm section, the back hand section, the thumb section, the index finger section, the middle finger section, the ring finger section and the baby finger section;

(c) a plurality of enhanced sections positioned on the glove having an enhanced physical characteristic in relation to the primary layer, the enhanced physical characteristic comprising at least one selected from the group consisting of increased cut resistance and increased abrasion resistance, and wherein the plurality of enhanced sections are positioned only on the back side of the thumb section, the back side of the index finger section, the back side of the middle finger section and the back side of the ring finger section; and (d) wherein the primary layer comprises a first yarn formed in the palm section, the back hand section, the thumb section, the index finger section, the middle finger section, the ring finger section and the baby finger section, and the enhanced sections are comprised of a second yarn knitted to the first yarn only at portions of the thumb section, the index finger section, the middle finger section, and the ring finger section.

2. The glove according to claim 1, wherein the enhanced sections have increased abrasion resistance in relation to the primary layer.

3. The glove according to claim 1, wherein the enhanced sections comprise one or more materials selected from the group consisting of ultra high molecular weight polyethylene, high tenacity nylon, high tenacity polyester, and liquid crystal polymer.

4. The glove according to claim 1, wherein the second yarn is knitted to the first yarn by a whole garment, computer controlled slide needle knitting machine.

5. The glove according to claim 1, wherein the second yarn has greater cut resistance than the first yarn, whereby the enhanced sections have enhanced cut resistance.

6. The glove according to claim 5, wherein the first yarn comprises:

(a) a core strand comprised of fiberglass;

(b) a first cover strand comprised of ultra high molecular weight polyethylene wrapped around the core; and (c) a second cover strand comprised of polyester wrapped over the first cover strand.

7. The glove according to claim 6, wherein the first yarn further comprises a third cover strand comprised of polyester wrapped over the second cover strand.

8. The glove according to claim 6, wherein the second yarn comprises:

(a) a core strand comprised of spandex; and (b) a cover strand comprised of ultra high molecular weight polyethylene wrapped around the core strand.

9. A cut resistant glove comprising:

(a) a primary layer of material defining a palm section, a back hand section, a thumb section, an index finger section, a middle finger section, a ring finger section and a baby finger section, wherein each of the thumb section, the index finger section, the middle finger section, the ring finger section and the baby finger section include a front side that is co-planar with the palm section and a back side that is co-planar with the back hand section; and (b) a secondary layer of material having increased cut resistance in relation to the primary layer knitted to the primary layer only on the back side of the thumb section, the back side of the index finger section, the back side of the middle finger section and the back side of the ring finger section.

10. The glove according to claim 9, wherein the secondary layer of material comprises one or more materials selected from the group consisting of ultra high molecular weight polyethylene, high tenacity nylon, high tenacity polyester, and liquid crystal polymer.

11. The glove according to claim 9, wherein the secondary layer comprises a yarn comprising of:

(a) a core strand comprised of spandex; and (b) a cover strand comprised of ultra high molecular weight polyethylene wrapped around the core strand.

12. The glove according to claim 9, wherein the primary layer is comprised of a yarn comprising:

(a) a core strand comprised of fiberglass;

(b) a first cover strand comprised of ultra high molecular weight polyethylene wrapped around the core; and (c) a second cover strand comprised of polyester wrapped over the first cover strand.

13. The glove according to claim 12, wherein the secondary layer comprises a yarn comprising of:

(a) a core strand comprised of spandex; and (b) a cover strand comprised of ultra high molecular weight polyethylene wrapped around the core strand.

14. The glove according to claim 9, wherein the secondary layer is knitted to the primary layer by a whole garment, computer controlled slide needle knitting machine.

* * * * *